United States Patent [19]

Rousseau et al.

[11] 4,222,336

[45] Sep. 16, 1980

[54] SIDE SILL ASSEMBLY

[75] Inventors: George L. Rousseau, Munster; Richard C. Snyder, Michigan City, both of Ind.

[73] Assignee: Pullman Incorporated, Chicago, Ill.

[21] Appl. No.: 894,976

[22] Filed: Apr. 10, 1978

[51] Int. Cl.[2] ..... B61D 17/00

[52] U.S. Cl. ..... 105/418; 105/409

[58] Field of Search ..... 105/418, 413, 409, 406 B, 105/247-248; 108/152; 52/264; 403/339

[56] References Cited

U.S. PATENT DOCUMENTS

| | | | |
|---|---|---|---|
| 746,385 | 12/1903 | Sage | 105/248 |
| 2,146,221 | 2/1939 | Meyer et al. | 105/406 R |
| 2,405,358 | 8/1946 | Johnson | 296/15 |
| 2,851,965 | 9/1958 | Leriche | 105/409 |
| 3,102,498 | 9/1963 | Dean | 105/409 |
| 3,151,573 | 10/1964 | Eggert, Jr. | 105/409 |
| 3,240,168 | 3/1966 | Charles et al. | 105/418 |
| 3,964,399 | 6/1976 | Miller et al. | 105/406 R |

*Primary Examiner*—Stephen G. Kunin
*Assistant Examiner*—Lawrence E. Williams
*Attorney, Agent, or Firm*—Richard J. Myers

[57] ABSTRACT

A side sill and side wall joint arrangement for a railway box car wherein channel shaped side sills are provided having inwardly offset upper vertical webs such that the side sheets of the car may be secured to them to provide a flat outer surface between the respective sheets and the lower portions of the sills against which straight side posts may be secured.

10 Claims, 5 Drawing Figures

SIDE SILL ASSEMBLY

BACKGROUND OF THE INVENTION

1. Field of the Invention

The present invention relates to railway box cars and more particularly to an improved side sill and side wall joint arrangement therefor.

2. Description of the Prior Art

The prior art is exemplified by U.S. Pat. Nos. 2,361,276; 2,602,405 and 3,089,439 and FIG. 5 of the drawings entitled "PRIOR ART" which shows a typical cross section of the joint between a side sill and associated side wall sheet and side post. It should be particularly noted that the side sheet is laterally offset from the vertical plane of the side sill and that the side post, which typically is welded to both the side sheet and the side sill, must be bent or outwardly offset to conform to the outer surfaces of the side sheet and sill.

The present invention is an improvement over these constructions as hereinafter disclosed.

SUMMARY OF THE INVENTION

The present invention relates to an improved side sill and side wall arrangement for railway box cars.

In the first embodiment of the invention a channel shaped side sill is provided having an upper vertical web portion inwardly offset such that the lower edge portion of the side sheet of the car may be secured to it and thus provide a flat outer surface between the side sheet and the lower vertical web of the side sill which will accommodate the application of a straight side wall post and thus optimumly utilize the vertical beam strength of the side sill to protect the joint between the side sheet and the sill.

A second embodiment of the invention provides for a side sill having an upper web portion inwardly offset to optimumly utilize the vertical beam strength of the side sill as in the first embodiment yet which extends vertically to the upper proximity of the car flooring to abate corrosion of the joint between the side sheet and the sill.

DESCRIPTION OF THE PREFERRED EMBODIMENT

Figure 1:
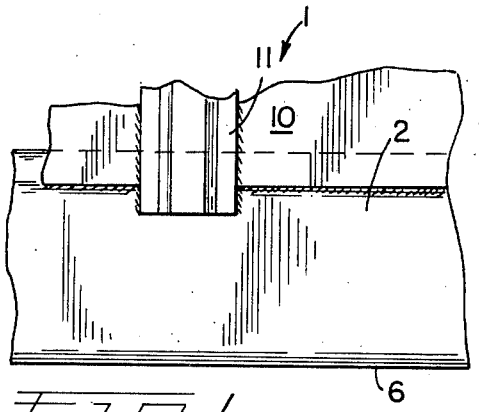
FIG. 1 is a fragmentary side elevation of the side sill and side wall arrangement of the first embodiment.
Figure 2:
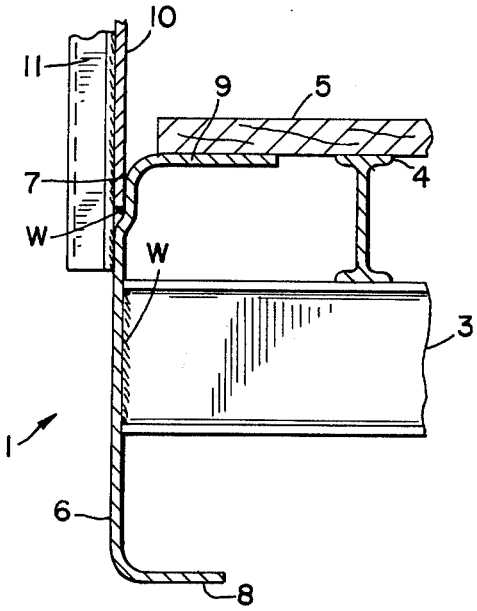
FIG. 2 is a cross-sectional view of FIG. 1.

Referring to the drawings and more particularly to the embodiment of the invention illustrated in FIGS. 1 and 2 thereof, the numeral 1 designates the railway box car side sill and side wall joint arrangement of the present invention. A side sill 2 is provided at each side of the car as are a plurality of longitudinally spaced crosstie members 3 extending therebetween. The crossties 3 are welded as at w or otherwise appropriately secured to the side sills 2 and support longitudinal floor stringers 4 which in turn carry the car flooring 5.

The side sill 2 of the present invention is of an essentially channel shaped section extending the length of the car and includes a lower vertical web portion 6 and an inwardly offset upper vertical web portion 7. To laterally rigidify the sill, inwardly extending lower and upper horizontal flanges 8 and 9 integral with respective web portions 6 and 7 are provided, the upper flange 9 abuting the flooring 5 or associated structure to support and seal or enclose the interior of the box car against the elements as desired.

As can be most easily seen from the drawings, the upper web portion 7 is inwardly offset to accommodate the thickness of the side wall sheet 10 which is secured thereto by welding w along the length of the side sill so as to provide a flat outer surface over the joint between the side sheet 10 and the lower vertical web portion 6 of the side sill to which a straight and thus easily fabricated external side wall post 11 of generally hat-shaped cross section may be secured by welding or the like. Since the side sheet 10 is essentially nestled or sandwiched between the upper portion of the web 7 and the side posts 11 and is horizontally aligned in the vertical plane of the lower web portion 6, the novel side sill and side wall joint arrangement of the present invention optimumly utilizes the vertical beam strength of the lower web 6 as well as the rigidity of the side posts 11 to minimize fatiguing loads on the welded joint between the side sheet 10 and the upper web portion 7, thus enhancing the structural integrity of the car as well as abating water damage or the like to the cargo as experienced in the past due to seepage through a fracture in the joint between the side sheet and the side sill.

Figure 3:
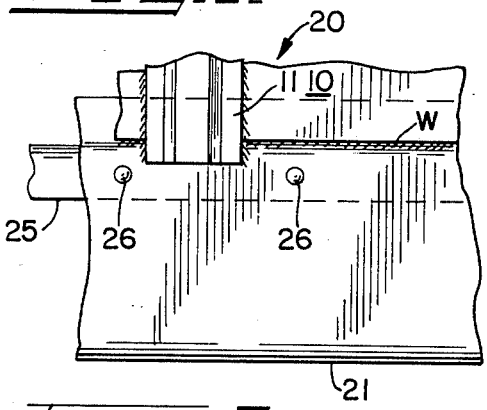
FIG. 3 is a fragmentary side elevation of the side sill and side wall arrangement of the second embodiment.
Figure 5:
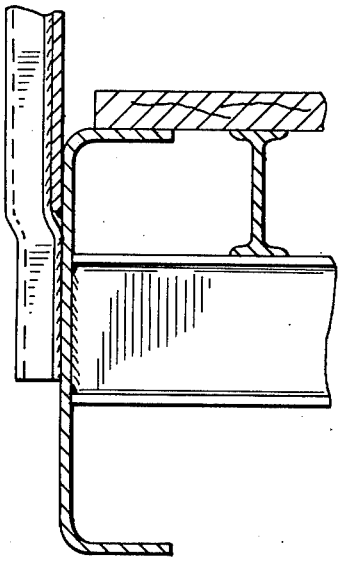
PRIOR ART FIG. 5.
FIG. 5 is a sectional view similar to FIGS. 2 and 4 illustrating a side sill construction typical of the prior art.
Figure 4:
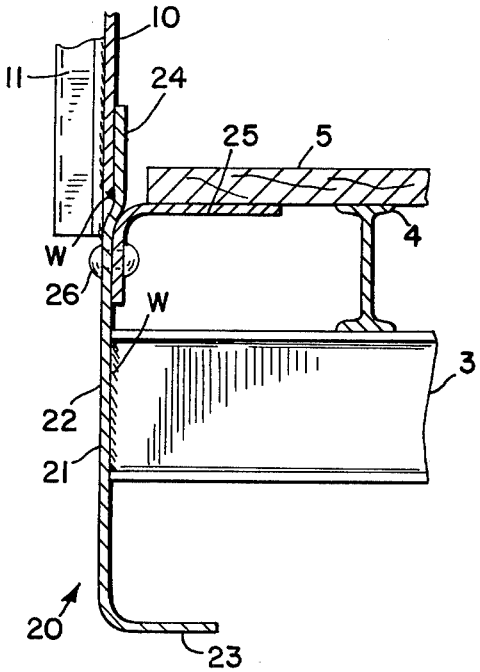
FIG. 4 is a cross-sectional view of FIG. 3.

FIGS. 3 and 4, wherein like structural elements are identified as above, illustrate the second embodiment of the invention which is particularly directed toward abating corrosion in the proximity of the joint between the side wall sheet and the side sill. The second embodiment of the side sill and the side wall joint arrangement 20 includes a generally L-shaped side sill portion 21 having a vertical web portion 22 and an inwardly extending laterally rigidifying lower flange portion 23 and an inwardly offset upper vertical web and sealing portion 24 extending vertically to the upper proximity of the flooring 5, both of which are coextensive with the side sill and joint arrangement 20. As in the first embodiment, the side wall sheet 10 is attached to the upper offset vertical portion 24 by welding w so as to provide a flat outer surface defined by the side sheet 10 and the vertical web portion 22 to accommodate application of the side posts 11 over the welded joint as discussed above. An upper inwardly extending lateral rigidifying flange 25 coextensive with the sill portion 21 is also provided and is secured thereto by rivets 26 or the like and may be cooperative with the flooring 5 or associated structure to seal the interior of the car against the elements. In this embodiment of the invention it should be particularly noted that by providing the vertical portion 24, which extends vertically to the upper proximity of the flooring 5, the structure provides for directing corrosive agents within the car away from the side sheet joint as well as providing an increased material thickness in an area susceptible to the deleterious effects of corrosion.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. In a railway box car having vertical side walls carried by a pair of longitudinally extending side sills and having a plurality of longitudinally spaced crossties extending therebetween supporting the car floor, an improved side sill and wall construction, comprising:

a side sill longitudinally coextensive with a respective side wall of the car and including upper and lower vertical web portions, said respective side wall having a vertical side sheet and a plurality of longitudinally spaced vertically extending side posts, each post having a flat inner attachment surface throughout its length and a lower end portion outwardly overlying and secured to said lower vertical web portion, said upper vertical web portion being inwardly offset from the vertical plane of said lower web portion a distance substantially the thickness of said side sheet, and said side sheet being nestled between the posts and the upper web portion and secured thereto in said vertical plane in a manner such that the side sill will carry the load transmitted through the side sheet.

2. The car according to claim 1, wherein said side sheet is integrally united with said upper web portion.

3. The car according to claim 1, wherein said side sill has upper and lower horizontal reinforcing flange portions extending inwardly from said upper and lower vertical web portions, respectively.

4. The car according to claim 1, and said side sill being of an integral construction.

5. The car according to claim 1, and said posts being generally hat-shaped in horizontal cross-section and integrally united with the side sheet and said lower web portion.

6. The car according to claim 1, wherein said lower vertical web portion has an inwardly extending horizontal reinforcing flange secured thereto and cooperating with the car floor .

7. The car according to claim 1, wherein said side sill has an inwardly extending horizontal reinforcing flange abutting the car floor to seal the interior of the car against the elements.

8. The car according to claim 1, wherein said offset upper vertical web portion extends vertically into the upper proximity of the car floor.

9. The car of claim 1, wherein said side sheet is welded to said offset vertical web portion along the bottom edge thereof.

10. The car of claim 9, wherein said offset upper vertical web portion terminates in a vertically extending flange portion which shields said welded bottom edge of said side sheet from corrosive agents within the car.

* * * * *